US005743519A

United States Patent [19]

Chang et al.

[11] Patent Number: 5,743,519

[45] Date of Patent: Apr. 28, 1998

[54] U-TURN HIGH CAPACITY SHEET FEEDER FOR FAX MACHINE OR PRINTERS

[76] Inventors: Joseph Chang; Shih-Chin Chang; Joe-Te Hsiung; C. Y. Chang, all of 1F, No. 26, Industry E. 9th Rd., Science-Based Industrial Park, Hsin Chu, Taiwan

[21] Appl. No.: 436,724

[22] Filed: May 8, 1995

[51] Int. Cl.[6] ..... B65H 5/00; B65H 1/22; B65H 5/34

[52] U.S. Cl. ..... 271/10.11; 271/10.13; 271/225; 271/164; 271/127; 271/264; 271/267; 271/270

[58] Field of Search ..... 271/3.18, 10.02, 271/10.11, 10.13, 225, 162, 164, 264, 267, 270, 126, 127, 902

[56] References Cited

FOREIGN PATENT DOCUMENTS

| | | | |
|---|---|---|---|
| 52840 | 4/1980 | Japan | 271/264 |
| 249857 | 10/1990 | Japan | 271/225 |
| 254682 | 10/1993 | Japan | 271/10.11 |
| 278911 | 10/1993 | Japan | 271/270 |
| 16276 | 1/1994 | Japan | 271/264 |
| 127777 | 5/1994 | Japan | 271/225 |

*Primary Examiner*—Boris Milef
*Attorney, Agent, or Firm*—Bo-In Lin

[57] ABSTRACT

A U-turn high capacity sheet feeder including: a sheet storing tray for holding a stack of sheets of paper, having a stack advancing spring for advancing a stack of sheets of paper; a transfer roll; a feed roll and a drive mechanism controlled to separate an individual sheet of paper from the sheet storing tray to the transfer roll for allowing it to be further driven by the transfer roll to a host machine; a U-turn baffle channel for guiding an individual sheet of paper moving away from the sheet storing tray to the transfer roll; a pivotable baffle channel for guiding an individual sheet of paper from the U-turn baffle channel to the host machine and for supporting the individual sheet of paper against the feed roll of the host machine; a control mechanism for determining the timings of the engagement of the feed roll and the drive mechanism for transporting individual sheets of paper one by one into the feed zone of the host machine in conjunction with feeding cycle of the host machine; and a housing, which holds the aforesaid parts of the sheet feeder.

6 Claims, 5 Drawing Sheets

U-TURN HIGH CAPACITY SHEET FEEDER FOR FAX MACHINE OR PRINTERS

BACKGROUND OF THE INVENTION

The present invention relates to sheet feeders for fax machines and printers, and relates more particularly to a U-turn high capacity sheet feeder for automatically feeding individual sheets of paper to a fax machine or printer which needs less installation space.

The sheet storing trays for different models or fax machines or printers are not exchangeable and have only a limited loading capacity. Therefore, different sheet storing trays are needed for different models of fax machines or printers. There are high capacity sheet feeders developed for use with fax machines or printers for feeding individual sheets of paper automatically. These high capacity sheet feeders are functional, however they require much installation space because they must be attached to the host machine at one lateral side.

SUMMARY OF THE INVENTION

The present invention has been accomplished to provide a U-turn high capacity sheet feeder which needs less installation space.

According to one embodiment of the present invention, the U-turn high capacity sheet feeder comprises: a sheet storing tray for holding a stack of sheets of paper, having a stack advancing means for advancing a stack of sheets of paper; a transfer roll; a feed roll and a drive mechanism controlled to separate an individual sheet of paper from the sheet storing tray to the transfer roll for allowing it to be further driven by the transfer roll to a host machine; a U-turn baffle channel for guiding an individual sheet of paper moving away from the sheet storing tray to the transfer roll; a pivotable baffle channel for guiding an individual sheet of paper from the U-turn baffle channel to the host machine and for supporting the individual sheet of paper against the feed roll of the host machine; a control mechanism for determining the timings of the engagement of the feed roll and the drive mechanism for transporting individual sheets of paper one by one into the feed zone of the host machine in conjunction with a feeding cycle of the host machine; and a housing, which holds the aforesaid parts of the sheet feeder.

According to another embodiment of the present invention, the U-turn high capacity sheet feeder is directly fixed to the bottom side of a host machine with the pivotable baffle channel mounted on the inside of the host machine.

DETAILED DESCRIPTION OF THE PREFERRED EMBODIMENTS

Figure 1:
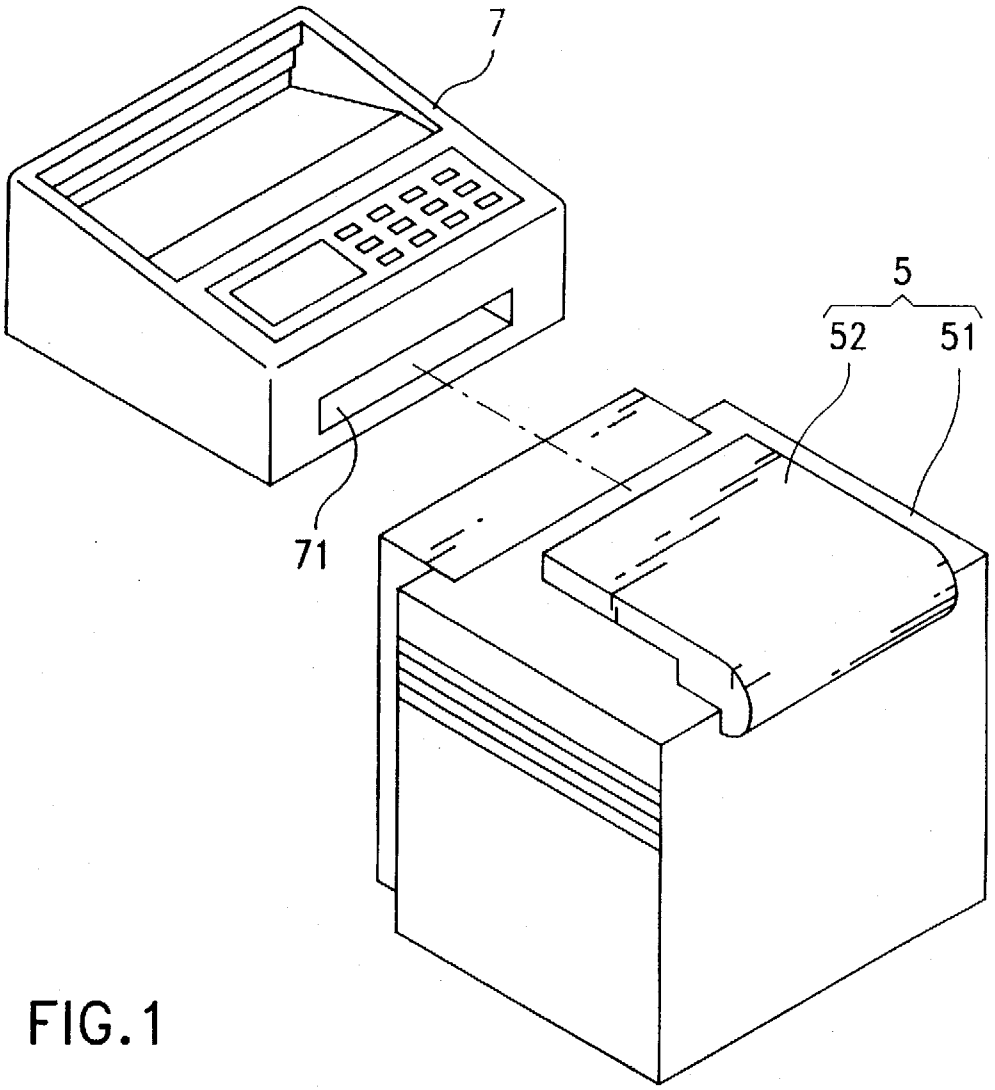
FIG. 1 is an elevational view of a U-turn high capacity sheet feeder according to the present invention.
Figure 2:
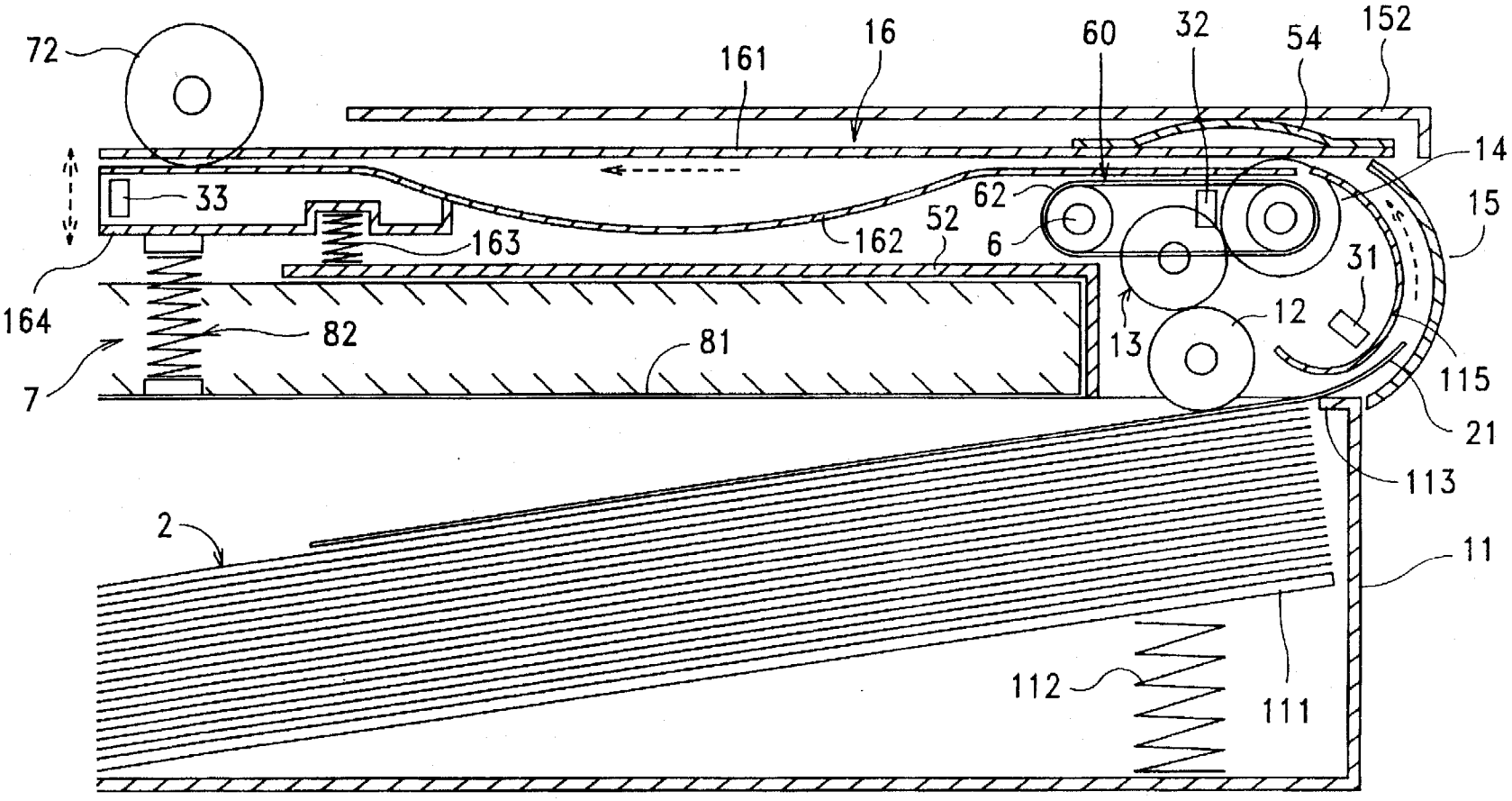
FIG. 2 is a side view in section of the U-turn high capacity sheet feeder shown in FIG. 1.
Figure 3:
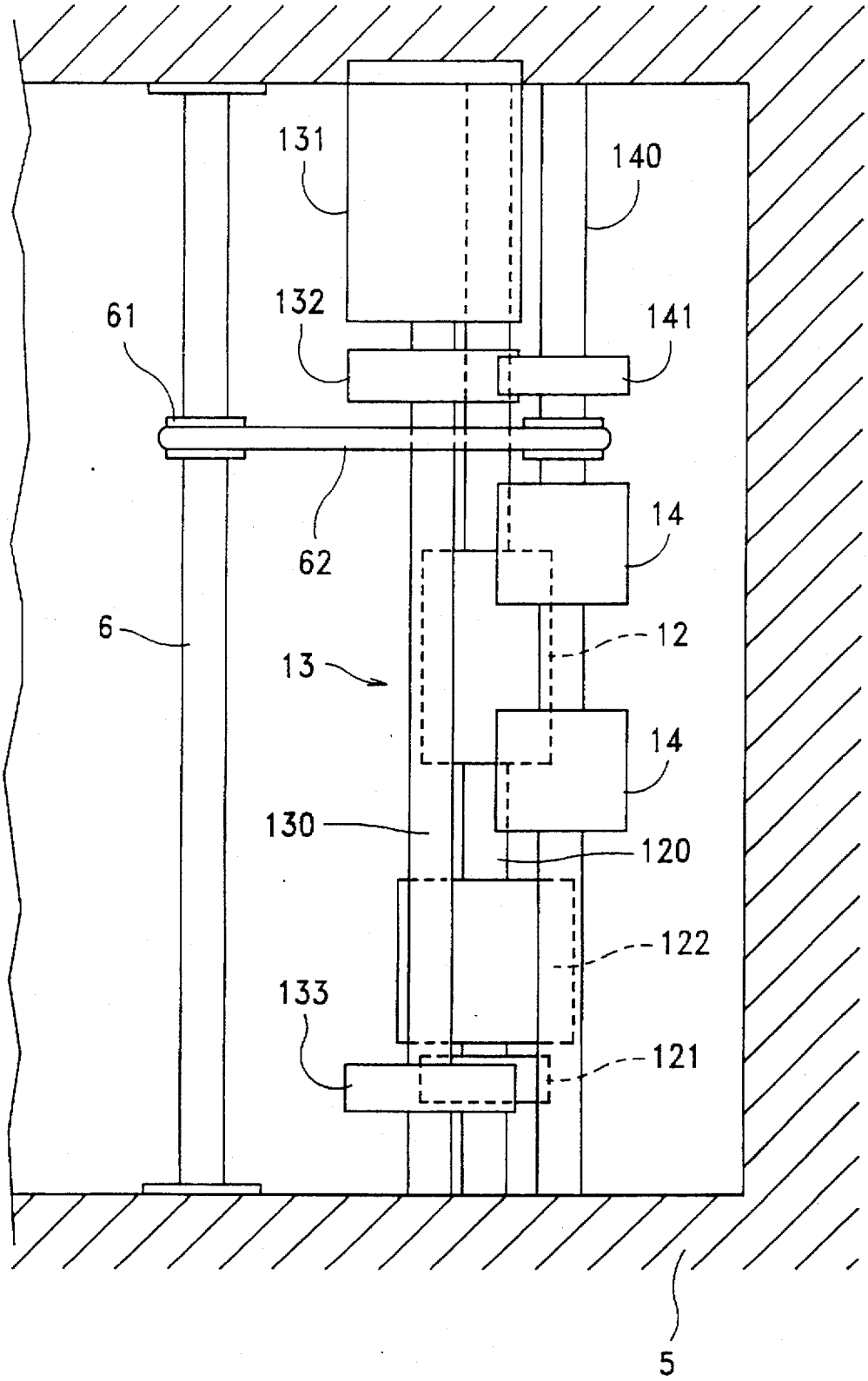
FIG. 3 is a top plan view in an enlarged scale of the drive mechanism for the U-turn high capacity sheet feeder according to the present invention.

Referring to FIGS. 1, 2, and 3, a U-turn high capacity sheet feeder in accordance with one embodiment of the present invention is generally comprised of a sheet storing tray 11, a feed roll 12, a drive mechanism 13, a pair of transfer rolls 14, a U-turn baffle channel consisting of a U-turn outer baffle board 15 and a U-turn inner baffle board 115, a pivotable baffle channel 16, a control mechanism, and a housing 5.

The sheet storing tray 11 comprises a paper board 111 for holding a stack of sheets of paper 2, and a stack advancing means, for example, a spring means 112 mounted on the bottom of the paper board 111 to give an upward pressure to the paper board 111, causing the stack of sheets of paper 2 to be retained between the feed roll 12 and the paper board 111. The feed roll 12 is mounted around a first revolving axle 120, which is fixedly mounted with a first driven gear 121 and a clutch 122. The drive mechanism 13 comprises a motor 131, a transmission shaft 130 turned by the motor 131, a first driving gear 132 fixedly mounted around the transmission shaft 130, and a second driving gear 133 fixedly mounted around the transmission shaft 130 and meshed with the first driven gear 121 on the first revolving axle 120. When the motor 131 is started to turn the transmission shaft 130, the first revolving axle 120 is turned by the second driving gear 133 through the first driven gear 121 to turn the feed roll 12, causing the feed roll 12 to separate a sheet of paper 21 from the stack of sheets of paper 2 through a paper outlet guide board 113 on the sheet storing tray 11 into the transfer rolls 14. The transfer rolls 14 are fixedly mounted around a second revolving axle 140, which is mounted with a second driven gear 141, which is meshed with the first driving gear 132. When the second driven gear 141 is turned by the first driving gear 132, the transfer rolls 14 delivers the individual sheet of paper 21 to the pivotable baffle channel 16. The U-turn outer baffle board 15 and the U-turn inner baffle board 115 is to guide the individual sheet of paper 21 moving away the sheet storing tray 11 to the transfer roll 14 in the opposite direction. The pivotable baffle channel 16 is to guide the individual sheet of paper 21 moving from the U-turn baffle channel 15 and 115 into the feed zone of the host machine (fax machine or printer) 7 and to support the individual sheet of paper 21 against the feed roll 72 of the host machine 7. The aforesaid control mechanism is to determine the timings of the engagement of the feed roll 12 and drive mechanism 13 for transporting individual sheets of paper one by one into the feed zone of the host machine 7 in conjunction with feeding cycle of the host machine 7, comprised of a first sensor 31, a second sensor 32, and a third sensor 33. The second sensor 32 detects the presence of an individual sheet of paper. If the second sensor 32 detects the presence of an individual sheet of paper, the drive mechanism 13 and the feed roll 12 and the endless belt 62 of a torque mechanism 60 are activated. When the endless belt 62 is rotated, a torque force is produced to compress a spring 163, causing the upper baffle board 161 of the pivotable baffle channel 16 left away from the feed roll 72 of the host machine 7 for letting the transmitted individual sheet of paper 21 to enter the host machine 7. If the second sensor 32 detects no signal, the motor 131 drives the feed roll 12 through the clutch 122, causing the feed roll 12 to separate an individual sheet of paper 21 from the sheet storing tray 11 until the trail edge of the individual sheet of paper 21 passes through the first sensor 31, which is mounted above the front end of the sheet storing tray 11. When the third sensor 33, which is mounted on the rear end of the pivotable baffle channel 16, detects the lead edge of the transmitted individual sheet of paper 21, it immediately de-activates the drive mechanism 13, and therefore the endless belt 62 of the torque mechanism 60 is stopped. When the endless belt 62 is stopped, the spring 163 immediately returns to its former shape to lift the pivotable baffle channel 16 back to its former position in contact with the feed roll 72 of the host machine 7, and therefore the individual sheet of paper 21 is retained in the stand-by position for further forward movement controlled by the host machine 7. When the first sensor 31 detects the parting of the trail edge of the individual sheet of paper 21 and the second sensor 32 detects the presence of the individual sheet of paper 21, the clutch 122 is closed, and the feed roll 12 is disconnected from the drive mechanism 13. The housing 5 comprises a first arm 51 and a second arm 52. The first arm 51 is provided to support the sheet storing tray 11. The second arm 52 is suspended above the first arm 51 to support the feed roll 12, the drive mechanism 13, the transfer roll 14, and the pivotable baffle channel 16. The second arm 52 is insertable into the tray area 71 of the host machine 7. The first arm 51 and the second arm 52 are connected by the U-turn baffle channel 15 and 115. The pivotable baffle channel 16 comprises an upper baffle board 161 and a lower baffle board 162. The lower baffle board 162 has a top surface smoothly curved inward, defining with the upper baffle board 161 a space sufficient for holding the trail end of the individual sheet of paper 21 when the lead end of the individual sheet of paper 21 reaches the front end of the pivotable baffle channel 16. Therefore, the pivotable baffle channel 16 contacts the feed roll 72 of the host machine 7 to hold down the lead end of the individual sheet of paper 21 only when the individual sheet of paper 21 is completely moved away from the transfer roll 14. This arrangement prevents the individual sheet of paper 21 from being constrained by the transfer roll 14 when the lead end of the individual sheet of paper 21 is moved to the feed roll 72 of the host machine. The lower baffle board 162 of the pivotable baffle channel 16 has an extended portion 164 supported on the aforesaid spring 163 and beyond the end of the second arm 52 of the housing 5. When the second arm 52 of the housing 5 is inserted into the tray area 71 of the host machine 7, the spring force of the spring 163 is compressed, causing the second arm 52 of the housing 5 firmly retained to the tray area 71 of the host machine 7. The second arm 52 is shorter than the first arm 51, therefore it does not touch the spring member 82 of the loading mechanism 81 of the host machine 7. The spring member 82 of the loading mechanism 81 of the host machine 7 forces the stack of sheets of paper (when the host machine 7 is separately used and the U-turn high capacity sheet feeder of the present invention is not attached to the host machine 7) into contact with the feed roll 72. When the U-turn high capacity sheet feeder is used, the upper baffle board 161, the lower baffle board 162 and the second arm 52 occupy the space in the tray area 71 for the stack of sheets of paper. When an individual sheet of paper 21 is transmitted from the U-turn high capacity sheet feeder into the host machine 7, the spring member 82 gives an upward pressure to the lower baffle board 162, causing the individual sheet of paper 21 to contact the feed roll 72. If the host machine 7 is not installed with the aforesaid spring member 82, the spring 163 can still provide sufficient upward pressure to the lower baffle board 162, causing the individual sheet of paper 21 to contact the feed roll 72. The aforesaid torque mechanism 60 which is comprised of an axle 6 disposed below the pivotable baffle channel 16 and an idle pulley 61 mounted around the axle 6, is controlled to move the pivotable baffle channel 16 relative to the feed roll 72 of the host machine 7. The idle pulley 61 is linked to the second revolving axle 140 by the aforesaid endless belt 62. The axle 6 is fixedly secured to the lower baffle board 162. When the second revolving axle 140 is turned by the motor 131, the idle pulley 61 is rotated by the endless belt 62, causing the lower baffle board 162 moved up and down relative to the feed roll 72 of the host machine 7. Furthermore, a spring plate 54 is supported between the upper baffle board 161 and the top cover 152 of the second arm 52 to give a downward pressure to the transfer roll 14 through the upper baffle board 161, and therefore the individual sheet of paper 21 can be positively moved by the transfer roll 14 into the pivotable baffle channel 16.

The operation of the present invention is outlined hereinafter with reference to FIGS. 2 and 3 again. When the host machine 7 is at the stand-by mode, the second sensor 32 detects the presence of an individual sheet of paper. If the second sensor 32 detects a signal, the drive mechanism 13 and the feed roll 12 do no work. If the second sensor 32 detects no signal, the feed roll 12 is turned by the drive mechanism 13 to separate an individual sheet of paper 21 from the sheet storing tray 11 through the U-turn baffle channel 15 and 115 into the pivotable baffle channel 16 toward the feed roll 72 of the host machine 7. When the third sensor 33 detects the presence of the individual sheet of paper 21, it immediately gives a signal to stop the transfer roll 14, and at the same time the idle pulley 61 is turned by the second revolving axle 140 through the endless belt 62 to lift the pivotable baffle channel 16, causing it to contact the feed roll 72 of the host machine 7 for letting the individual sheet of paper 21 to be moved into the host machine 7 for printing. Immediately after the first sensor 31 and the second sensor 32 detect a signal, the first sensor 32 stops the detection and gives a signal to shut off the clutch 122, causing the feed roll 12 disengaged from the drive mechanism 13. The aforesaid procedure is repeated again and again when the host machine 7 is continuously operated.

Figure 4:
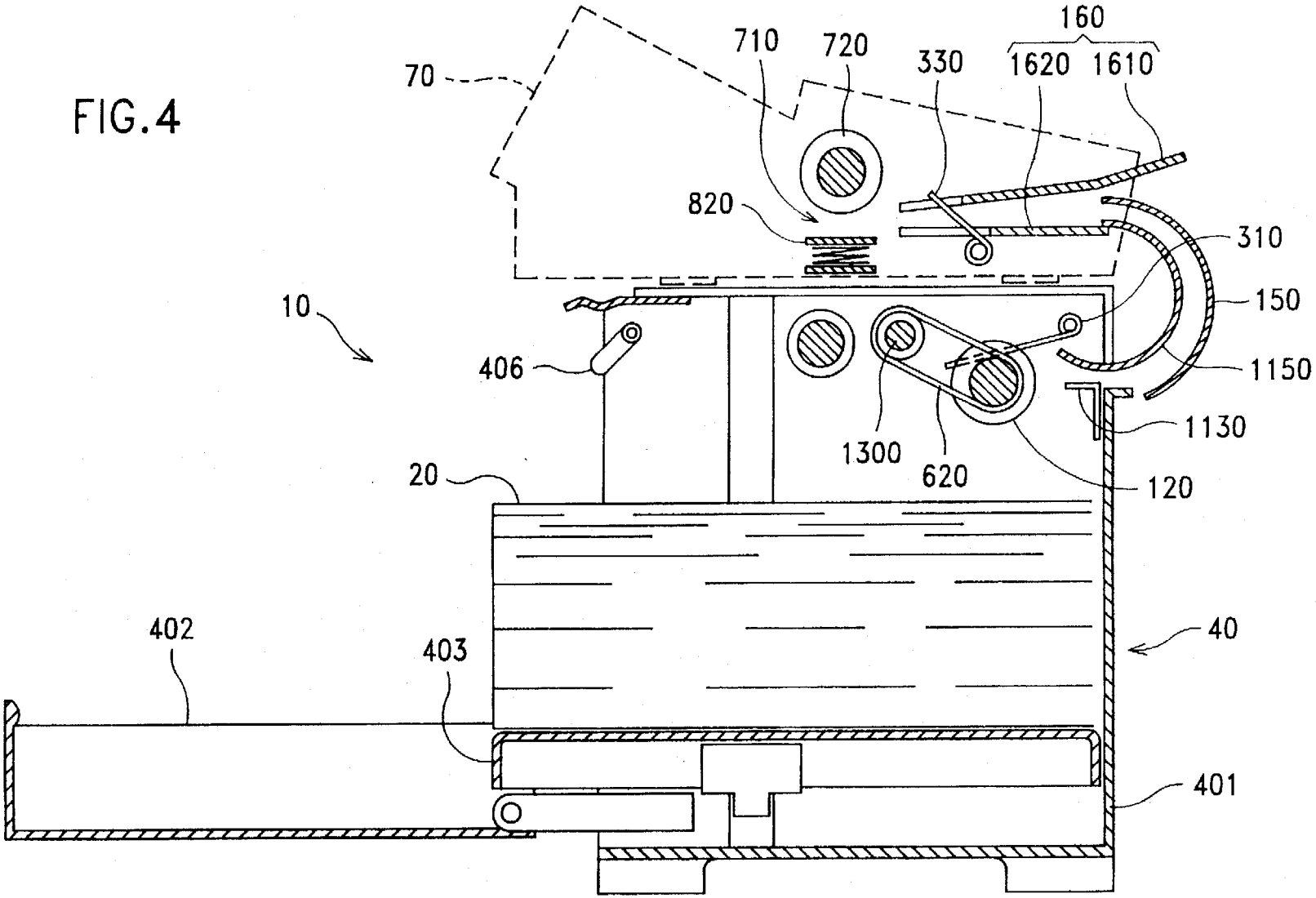
FIG. 4 is a side view in section of an alternate form of the present invention.
Figure 5:
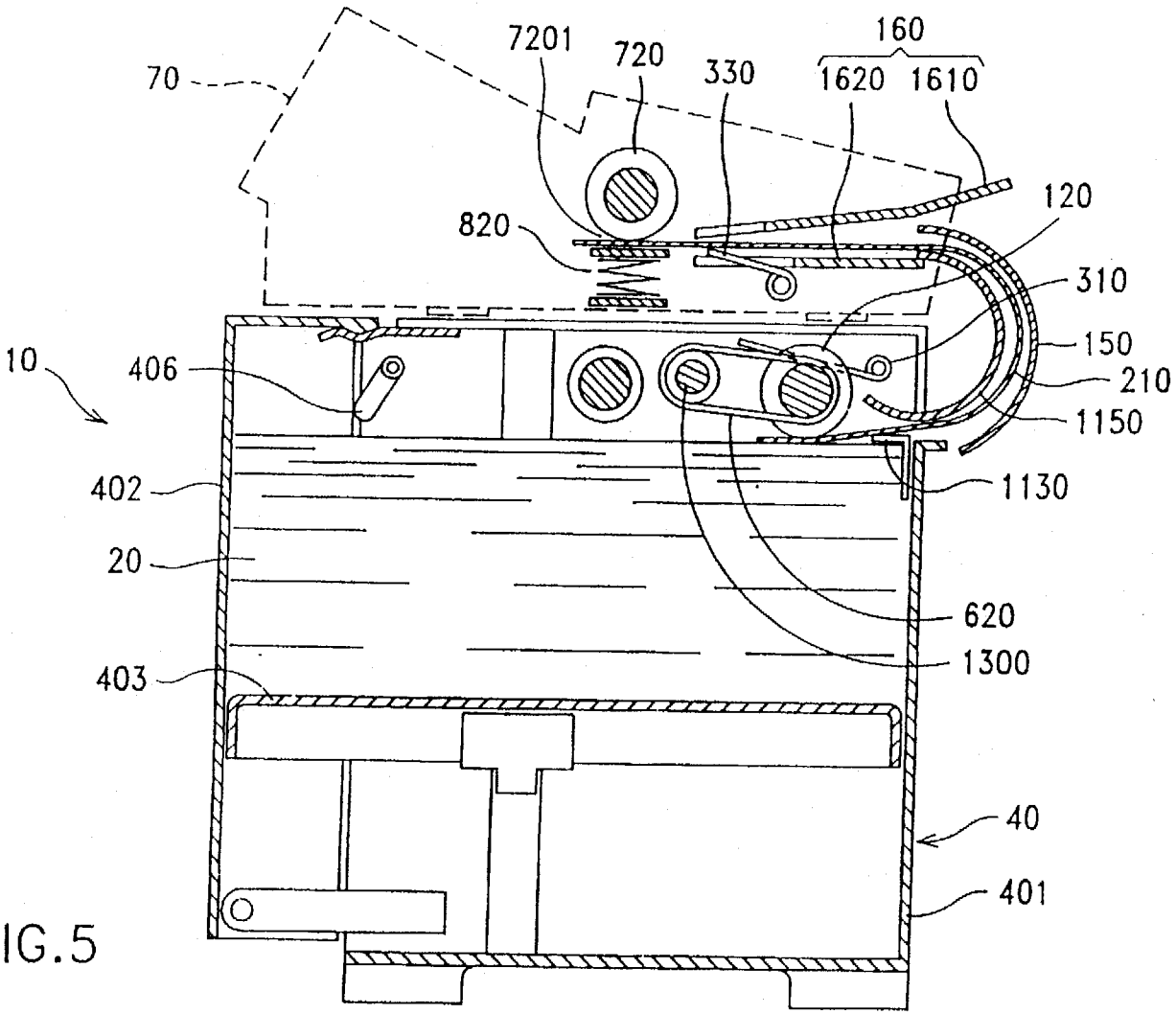
FIG. 5 is similar to FIG. 4 but showing the cover closed and the feed roll disposed in contact with the stack of sheets of paper.

FIGS. 4 and 5 show an alternate form of the present invention. As illustrated, a U-turn high capacity sheet feeder 10 is fixedly secured to the bottom side of a host machine (fax machine or printer) 70, comprised of a U-turn baffle channel 150 and 1150, a pivotable baffle channel 160 consisting of an upper baffle board 1610 and a lower baffle board 1620 and extended from the U-turn baffle channel 150 and 1150 into the tray area 710 of the host machine 70, a sheet storing tray 40, a first switch type sensor 310 installed in the sheet storing tray 40 at the top, and a second switch type sensor 330 installed in the pivotable baffle channel 160. The sheet storing tray 40 comprises a bottom chamber 401, a bottom cover 402, a paper tray 403, and a stack advancing means installed in the bottom chamber 401. When a stack of sheets of paper 20 is loaded on the paper board 403 inside the sheet storing tray 40, the paper board 403 is lowered to the bottom side. When the bottom cover 402 is opened, the first switch type sensor 310 is turned off, and therefore the feed roll 120 of the U-turn high capacity sheet feeder 10 does not work, i.e., no sheet of paper will be separated from the stack in the sheet storing tray 40 into the U-turn baffle channel 150 and 1150 (as shown in FIG. 4). When the bottom cover 402 is closed, a switch 406 is switched on, causing the stack advancing means to lift the paper board 403, and the stack of sheets of paper 20 is forced to contact the feed roll 120. When the stack of sheets of paper 20 touches the feed roll 120, the first switch type sensor 310 is turned on to start a motor (not shown), causing it to turn the feed roll 120 through a revolving shaft 1300 and a transmission belt 620, and therefore an individual sheet of paper 210 is separated from the stack in the sheet storing tray 40 and moved through a guide board 1130 on the top side of the sheet storing tray 40 into the U-turn baffle channel 150 and 1150. When the individual sheet of paper 210 is moved into the U-turn baffle channel 150 and 1150 and touches the second sensor 330, the second sensor 330 is triggered to count down a predetermined length of delay time, which is set by a control circuit (not shown). When the predetermined length of delay time is up, the lead end of the individual sheet of paper 210 is forwarded into the stand-by position retained in the gap 7201 between the spring member 820 and the feed roll 720 of the host machine 70. When the feed roll 720 of the host machine 70 is operated, the individual sheet of paper 210 is then forwarded into the printing position for printing.

It is to be understood that the drawings are designed for purposes of illustration only, and are not intended as a definition of the limits and scope of the invention disclosed.

What is claimed is:

1. A U-turn high capacity sheet feeder having:

a sheet storing tray for holding a stack of sheets of paper, said sheet storing tray having a stack advancing means for advancing said stack of sheets of paper;

a transfer roll;

a feed roll and a drive mechanism controlled to separate an individual sheet of paper from said stock held by said sheet storing tray to said transfer roll for allowing said sheet to be further driven by said transfer roll to a host machine;

a U-turn baffle channel for guiding the individual sheet of paper moving away from said sheet storing tray to said transfer roll;

a pivotable baffle channel for guiding the individual sheet of paper from said U-turn baffle channel to said host machine and for supporting the individual sheet of paper against a feed roll of said host machine;

a control mechanism for determining the timings of the engagement of the sheet separating feed roll and the drive mechanism for transporting individual sheets of paper one by one into a feed zone of said host machine in conjunction with a feeding cycle of said host machine;

a housing, which receives said sheet storing tray, said transfer roll, said sheet separating feed roll and said drive mechanism, said U-turn baffle channel, said pivotable baffle channel, and said control mechanism;

and said housing comprises a first arm for supporting said sheet storing tray, and a second arm suspended above said first arm for supporting said sheet separating feed roll, said drive mechanism, said transfer roll, and said pivotable baffle channel, said second arm being insertable into a tray area of said host machine, said first arm and said second arm being connected by said U-turn baffle channel.

2. The U-turn high capacity sheet feeder of claim 1 wherein said pivotable baffle channel comprises an upper baffle board and a lower baffle board, said lower baffle board having a top side smoothly curved inwards and defining with said upper baffle board a space sufficient for holding the trail end of an individual sheet of paper when the lead end of the individual sheet of paper reaches the front end of the pivotable baffle channel, and a bottom, side supported on said second arm by a spring member.

3. The U-turn high capacity sheet feeder of claim 2 further comprising a top cover on said second arm, wherein a spring plate is supported between said upper baffle board and said top cover on said second arm to give a downward pressure to said transfer roll through said upper baffle board, for allowing an individual sheet of paper to be positively moved by said transfer roll into said pivotable baffle channel.

4. The U-turn high capacity sheet feeder of claim 1 wherein said pivotable baffle channel comprises an extended portion, said extended portion being suspendable below the feed roll of said host machine and movable to form a drive nip by contact with the feed roll of said host machine.

5. The U-turn high capacity sheet feeder of claim 1 further comprising a torque mechanism controlled to reciprocate said pivotable baffle channel relative to the feed roll of said host machine, said torque mechanism comprising an axle disposed below said pivotable baffle channel, an idle pulley mounted around said axle, and an endless belt mounted around said idle pulley and turned by said drive mechanism.

6. The U-turn high capacity sheet feeder of claim 1 wherein said sheet separating feed roll of said U-turn high capacity sheet feeder is fixedly mounted around a first revolving axle, said first revolving axle being mounted with a first driven gear and a clutch; said drive mechanism comprises a motor, a transmission shaft turned by said motor, a first driving gear fixedly mounted around said transmission shaft, and a second driving gear fixedly mounted around said transmission shaft and meshed with said first driven gear, said first revolving axle being turned by said second driving gear through said first driven gear to turn said sheet separating feed roll of said U-turn high capacity sheet feeder when said motor is started to turn said transmission shaft; said transfer roll being fixedly mounted around a second revolving axle, said second revolving axle being mounted with a second driven gear meshed with said first driving gear, said transfer roll delivering an individual sheet of paper to said pivotable baffle channel when said second driven gear is turned by said first driving gear.

* * * * *